US012584313B2

(12) United States Patent
Weng et al.

(10) Patent No.: US 12,584,313 B2
(45) Date of Patent: Mar. 24, 2026

(54) FLOOR AND WALLBOARD CONNECTING STRUCTURE FOR SHED

(71) Applicant: JINGNING MEIGE TECHNOLOGY SERVICE CO., LTD., Lishui (CN)

(72) Inventors: Dawei Weng, Lishui (CN); Haoliang Hu, Lishui (CN); Yifan Zhai, Lishui (CN)

(73) Assignee: JINGNING MEIGE TECHNOLOGY SERVICE CO., LTD., Lishui (CN)

( * ) Notice: Subject to any disclaimer, the term of this patent is extended or adjusted under 35 U.S.C. 154(b) by 265 days.

(21) Appl. No.: 18/585,087

(22) Filed: Feb. 23, 2024

(65) Prior Publication Data

US 2025/0188740 A1 Jun. 12, 2025

(30) Foreign Application Priority Data

Dec. 7, 2023 (CN) ..... 202311668288.5

(51) Int. Cl.
*E04C 2/40* (2006.01)
*E04B 2/00* (2006.01)

(52) U.S. Cl.
CPC . *E04C 2/40* (2013.01); *E04C 2/46* (2013.01)

(58) Field of Classification Search
CPC ..... E04C 2/40; E04C 2/46; E04B 2/00; E04B 1/612; E04B 1/6125; E04F 15/02
See application file for complete search history.

(56) References Cited

U.S. PATENT DOCUMENTS

| | | | | |
|---|---|---|---|---|
| 6,966,449 | B2 * | 11/2005 | Williams | B65D 19/18 206/509 |
| 8,978,319 | B2 * | 3/2015 | Patino | E04H 1/02 52/745.02 |
| 9,328,503 | B1 * | 5/2016 | Patino | E04C 2/52 |
| 9,598,856 | B2 * | 3/2017 | Schulte | A47B 47/042 |
| 10,626,622 | B2 * | 4/2020 | Huang | E04F 15/02 |
| 12,304,692 | B1 * | 5/2025 | Zhai | B65D 11/20 |
| 12,480,303 | B2 * | 11/2025 | Jiang | E04B 1/6137 |
| 12,486,659 | B2 * | 12/2025 | Jiang | E04B 1/6137 |
| 2004/0129699 | A1 * | 7/2004 | Williams | B65D 11/1873 220/4.31 |

(Continued)

FOREIGN PATENT DOCUMENTS

CN 218438516 U 2/2023

*Primary Examiner* — Rodney Mintz
(74) *Attorney, Agent, or Firm* — Bayramoglu Law Offices LLC

(57) ABSTRACT

A floor and wallboard connecting structure for a shed includes a floor and a wallboard, where the wallboard includes multiple first support plates and multiple second support plates; the second support plates are located at corners of a shed; the first support plates each are connected to an adjacent first support plate or second support plate; one end of a bottom of the first support plate is provided with a first positioning protrusion, and one end of a bottom of the second support plate is also provided with a first positioning protrusion; the floor is provided with first positioning grooves; the first positioning grooves are fit with the first positioning protrusions to limit one end of a bottom of the wallboard to the floor; the first positioning grooves are arc-shaped grooves; and the first positioning protrusions are rotatable in the first positioning grooves.

8 Claims, 18 Drawing Sheets

(56) References Cited

U.S. PATENT DOCUMENTS

| | | | | |
|---|---|---|---|---|
| 2007/0175108 | A1* | 8/2007 | Stein | E04B 1/34321 52/79.5 |
| 2008/0216426 | A1* | 9/2008 | Bunker | E04B 1/34315 52/285.3 |
| 2012/0005968 | A1* | 1/2012 | Patino | E04H 1/02 52/745.13 |
| 2015/0368896 | A1* | 12/2015 | Schulte | F16B 12/125 403/364 |
| 2019/0234081 | A1* | 8/2019 | Huang | E04F 15/02038 |
| 2024/0035271 | A1* | 2/2024 | Jiang | E04B 1/34384 |
| 2024/0035272 | A1* | 2/2024 | Jiang | E04B 1/6162 |
| 2024/0254768 | A1* | 8/2024 | Boo | E04C 2/10 |
| 2025/0188749 | A1* | 6/2025 | Weng | E04F 13/0894 |

* cited by examiner

FLOOR AND WALLBOARD CONNECTING STRUCTURE FOR SHED

CROSS REFERENCE TO RELATED APPLICATIONS

This application is based upon and claims foreign priority to Chinese Patent Application No. 202311668288.5, filed on Dec. 7, 2023, the entire contents of which are incorporated herein by reference.

TECHNICAL FIELD

The present disclosure relates to the technical field of outdoor sheds, and in particular to a floor and wallboard connecting structure for a shed.

BACKGROUND

Sheds are generally set up in outdoor places such as gardens and mainly used to store tools such as shovel, hoes, and lawn mowers. Traditional sheds have complex structures and their assembly is labor-intensive.

Chinese patent application CN2022226698772 provides a structurally reliable shed, including two rectangular enclosing frames arranged at intervals up and down and multiple wallboards connected between the two enclosing frames. At least one of the enclosing frames includes four right-angled connectors and four edging components. Each edging component includes an inner wall formed by a double-layer stepped structure and an outer wall formed by a three-layer stepped structure. The four edging components are connected end to end to form a rectangular structure. The four right-angled connectors are arranged inside four corners of the rectangular structure and on first inner step surfaces of the edging components. The two right-angled sides of the right-angled connector are respectively butted with first inner step walls of two adjacent edging components and fixedly connected by screws. The wallboard includes an end placed on a second outer step surface of the edging component and an inner wall butted with a second outer step wall of the edging component and fixedly connected by a screw. The special construction of the right-angled connectors and the edging components ensures the overall strength and structural reliability of the shed. However, during assembly, it is difficult to ensure the sealing tightness between the wallboards at the four corners, and the entire wallboard needs to be raised so as to embed the bottom of the wallboard into the enclosing frame. In addition, during disassembly, the entire wallboard needs to be raised to remove it from the enclosing frame, which is difficult for users with low strength, causing great inconvenience to the disassembly of the shed.

SUMMARY

In response to the shortcomings of the prior art, the present disclosure provides a floor and wallboard connecting structure for a shed, which greatly facilitates the assembly of the shed and improves the sealing tightness between the wallboards of the shed.

In order to solve the above technical problem, the present disclosure adopts the following technical solution. A floor and wallboard connecting structure for a shed includes a floor and a wallboard, where the wallboard includes multiple first support plates and multiple second support plates; the second support plates are located at corners of a shed; the first support plates each are connected to an adjacent first support plate or second support plate; one end of a bottom of the first support plate is provided with a first positioning protrusion, and one end of a bottom of the second support plate is also provided with a first positioning protrusion; the floor is provided with first positioning grooves; the first positioning grooves are fit with the first positioning protrusions to limit one end of a bottom of the wallboard to the floor; the first positioning grooves are arc-shaped grooves; and the first positioning protrusions are rotatable in the first positioning grooves.

In a preferred implementation, the second support plates each include a first working plate and a second working plate; a side of the first working plate is connected to a side of the second working plate; and after the first working plate and the second working plate are connected, an angle between the first working plate and the second working plate is greater than 0° but less than 180°.

In a preferred implementation, after the first working plate and the second working plate are connected, the angle between the first working plate and the second working plate is 90°.

In a preferred implementation, a concave of the arc-shaped groove faces outward.

In a preferred implementation, two sides of the first support plate are provided with first clamping connectors and first clamping grooves, and two sides of the second support plate are provided with second clamping connectors and second clamping grooves; the first clamping connectors are fit with the second clamping grooves, and the second clamping connectors are fit with the first clamping grooves, thereby connecting the first support plate to the second support plate; and if any two adjacent first support plates are defined as a first plate and a second plate, respectively, then the first clamping connectors of the first plate are fit with the first clamping grooves of the second plate, and the first clamping grooves of the first plate are fit with the first clamping connectors of the second plate, thereby connecting the two adjacent first support plates;

In a preferred implementation, the two sides of the first support plate are provided with first protrusions; the first protrusions are spaced from the first clamping grooves; the first clamping connector is provided on the first protrusion; the two sides of the second support plate are provided with second protrusions; the second protrusions are spaced from the second clamping grooves; the second clamping connector is provided on the second protrusion; the first protrusion has a length smaller than a length of the first clamping groove and a length of the second clamping groove; and the second protrusion has a length smaller than the length of the first clamping groove and the length of the second clamping groove.

In a preferred implementation, a first connecting plate is provided at a junction between each two adjacent first support plates; a second connecting plate is provided at a junction between the first support plate and the second support plate; and the first connecting plate and the second connecting plate are provided inside the shed.

In a preferred implementation, the floor is provided with multiple first limit protrusions; an inner wall of the wallboard is provided with multiple first recesses; the first recesses are located at the bottom of the wallboard; and the first limit protrusions are fit with the first recesses to connect the wallboard to the floor.

In a preferred implementation, the floor is provided with a step surface; the first limit protrusion and the first positioning groove are provided on the step surface; and after the wallboard is connected to the floor, the bottom of the wallboard is located on the step surface.

In a preferred implementation, a second slope is provided at an edge of the step surface.

In a preferred implementation, the step surface is provided with multiple protrusions, and the bottom of the wallboard is provided with multiple grooves; the protrusions correspond one-to-one with the grooves in terms of quantity and position; and after the wallboard is connected to the floor, the protrusions are located in the grooves.

In a preferred implementation, the protrusions are raised bars or ridges; and the protrusions each are provided with a first slope.

In a preferred implementation, the first positioning groove includes a first mounting point and a second mounting point; the bottom of the first support plate is provided with a second positioning protrusion; the second positioning protrusion is provided at an end far away from the first positioning protrusion; and if any two adjacent first support plates are defined as a first plate and a second plate, respectively, then after the first plate and the second plate are connected to the floor, the first positioning protrusion of the first plate is located at the first mounting point, and the second positioning protrusion of the second plate is located at the second mounting point.

In a preferred implementation, a height of the first positioning protrusion is defined as H1, and a height of the second positioning protrusion is defined as H2, H2<H1.

Compared with the prior art, in the present disclosure, the wallboard includes multiple first support plates and multiple second support plates. The first support plates each are connected to an adjacent first support plate or second support plate. The second support plates are located at corners of the shed and the first support plates are located at other positions of the shed to strengthen the connection tightness of the wallboard at the corners. One end of the bottom of the first support plate is provided with a first positioning protrusion, and one end of a bottom of the second support plate is also provided with a first positioning protrusion. The floor is provided with first positioning grooves. The first positioning groove is an arc-shaped groove. The first positioning protrusion is rotatable in the first positioning groove. When the wallboard is mounted on the floor, first, the end with the first positioning protrusion is inserted into the first positioning groove, and the first positioning protrusion is taken as a fulcrum to rotate the wallboard, thereby connecting the bottom of the wallboard to the floor. That is, during mounting, only a position of the bottom of the wallboard needs to be raised to connect the floor, without the need to raise the entire bottom of the wallboard, making the mounting labor-saving and convenient.

BRIEF DESCRIPTION OF THE DRAWINGS

The present disclosure will be further described in detail below with reference to the drawings and preferred embodiments. However, those skilled in the art should understand that these drawings are drawn only for the purpose of explaining the preferred embodiments, and therefore should not be construed as a limitation to the scope of the present disclosure. In addition, unless otherwise specified, the drawings are only intended to conceptually represent the composition or configuration of the described objects and may include exaggerated displays, and the drawings are not necessarily drawn to scale.

REFERENCE NUMERALS

Figure 1:
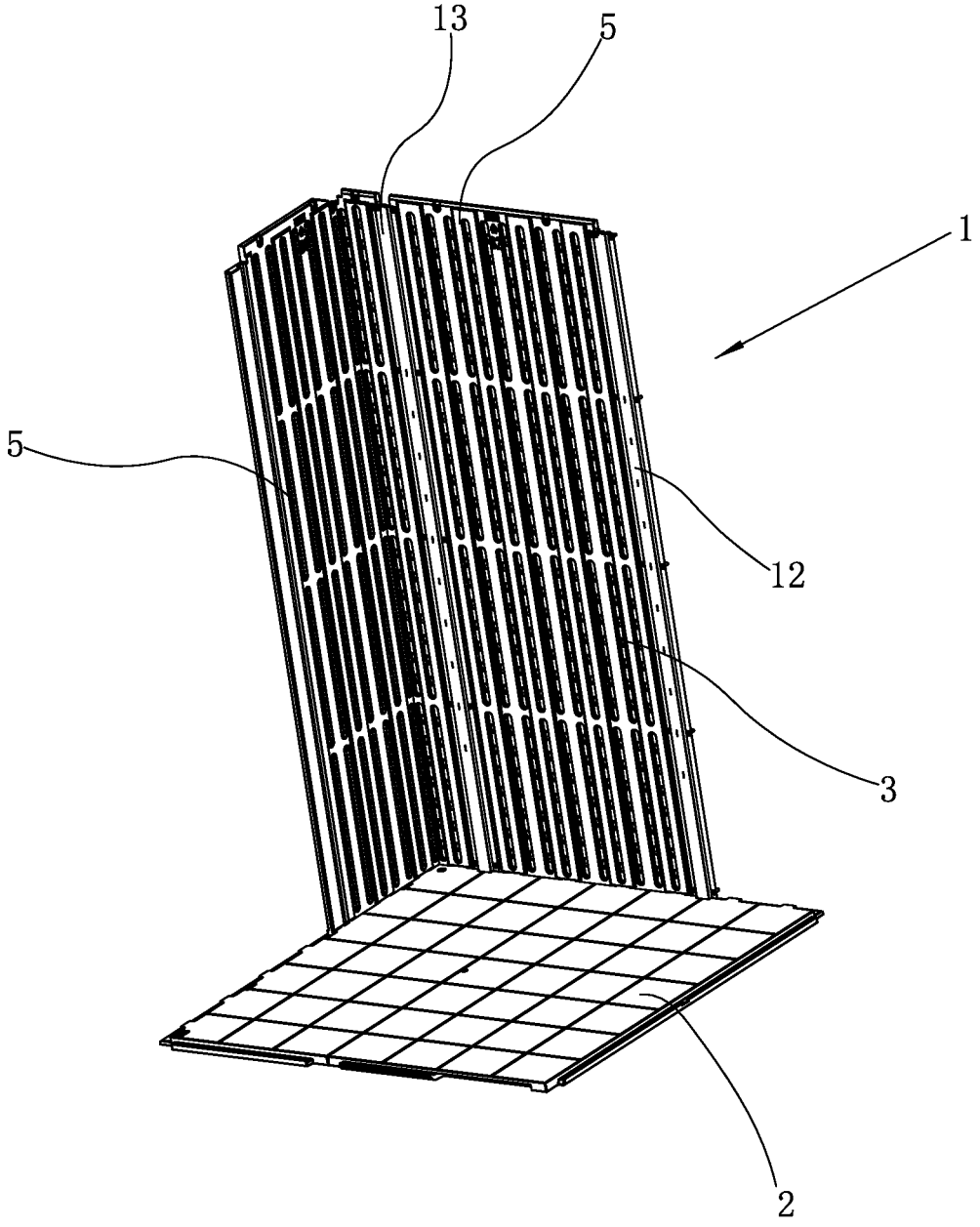
FIG. 1 is a first structural diagram of a floor and wallboard connecting structure for a shed according to the present disclosure.
Figure 2:
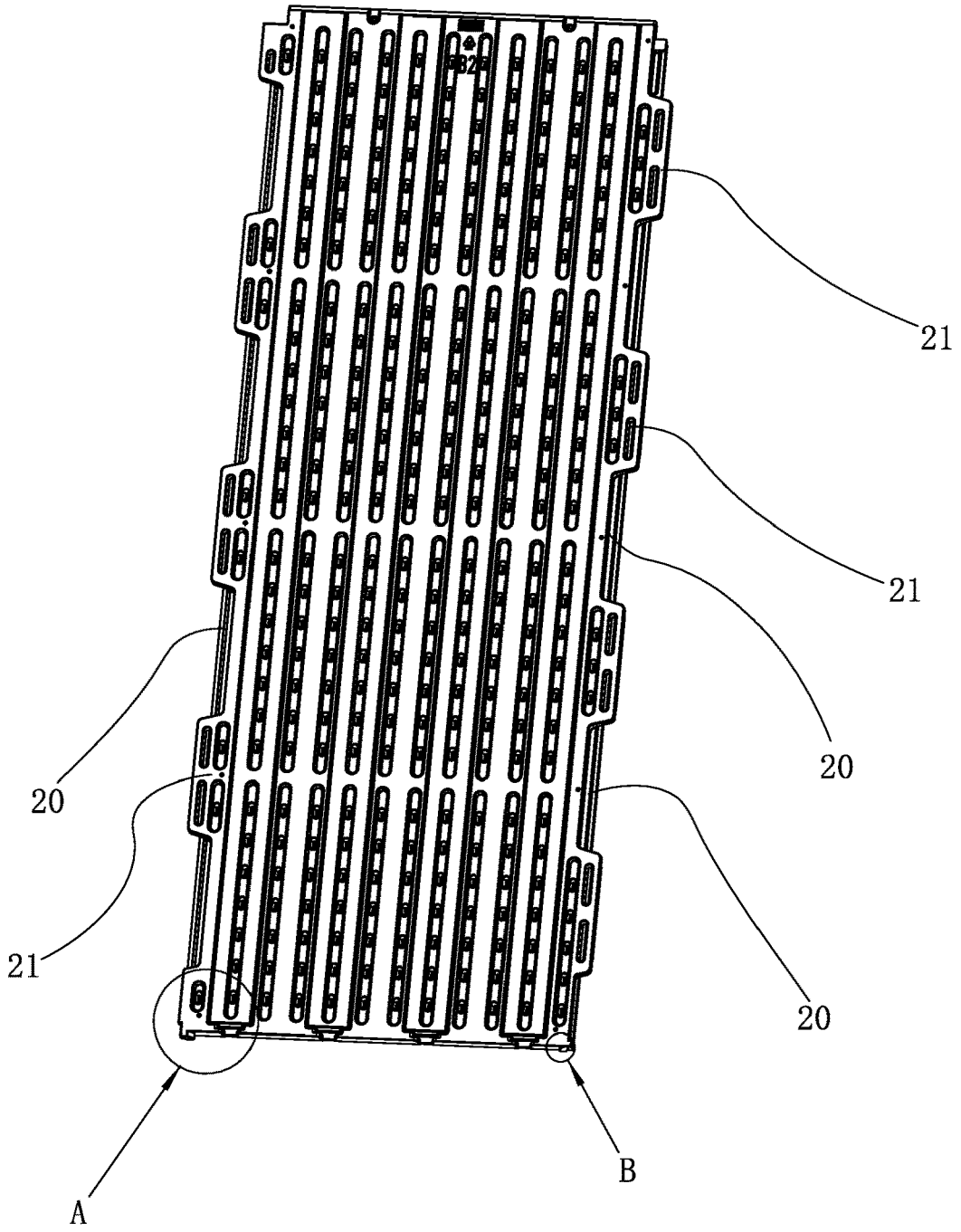
FIG. 2 is a first structural diagram of a first support plate according to the present disclosure.

1. wallboard; 2. floor; 3. first support plate; 4. first clamping connector; 5. second support plate; 6. second clamping connector; 7. first working plate; 8. second working plate; 9. first positioning protrusion; 10. second positioning protrusion; 11. first recess; 12. first connecting plate; 13. second connecting plate; 14. first limit protrusion; 15. protrusion; 16. first positioning groove; 17. hollow part; 18. second slope; 19. step surface; 20. first clamping groove; 21. first protrusion; 22. second clamping groove; and 23. second protrusion.

DETAILED DESCRIPTION OF THE EMBODIMENTS

In order for those skilled in the art to better understand the technical solution of the present disclosure, the present disclosure is described in detail clearly and completely below in combination with the drawings and embodiments. It should be understood that the specific embodiments described herein are merely intended to explain the present disclosure, rather than to limit the present disclosure.

It is understandable for those skilled in the art that in the description of the present disclosure, terms such as "longitudinal", "transverse" "upper", "lower", "front", "rear", "left", "right" "vertical", "horizontal", "top", "bottom", "inside", and "outside" indicate the orientation or position relationships based on the drawings. They are merely intended to facilitate and simplify the description of the present disclosure, rather than to indicate or imply that the mentioned system or components must have a specific orientation or must be constructed and operated in a specific orientation. Therefore, these terms should not be construed as a limitation to the present disclosure.

As shown in FIGS. 1 to 3, 5, 6, and 8, an embodiment of the present disclosure provides a floor and wallboard connecting structure for a shed, including floor 2 and wallboard 1 that are detachably connected. The wallboard 1 includes multiple first support plates 3 and multiple second support plates 5. The second support plates 5 are located at corners of the shed and the first support plates 3 are located at other positions of the shed to strengthen the connection tightness of the wallboard 1 at the corners. The first support plate 3 is connected to adjacent first support plate 3 or second support plate 5. One end of a bottom of the first support plate 3 is provided with first positioning protrusion 9, and one end of a bottom of the second support plate 5 is provided with first positioning protrusion 9. The floor 2 is provided with first positioning grooves 16. The first positioning groove 16 and the first positioning protrusion 9 are fit with each other to limit the one end of the bottom of the wallboard 1 to the floor 2. The first positioning groove 16 is an arc-shaped groove. The first positioning protrusion 9 is rotatable in the first positioning groove 16. When the wallboard 1 is mounted on the floor 2, first, the end with the first positioning protrusion 9 is inserted into the first positioning groove 16, and the first positioning protrusion 9 is taken as a fulcrum to rotate the wallboard 1, thereby connecting the bottom of the wallboard to the floor 2. That is, during mounting, only a position of the bottom of the wallboard 1 needs to be raised to connect the floor 2, without the need to raise the entire bottom of the wallboard 1, making the mounting labor-saving and convenient. During disassembly, first, an end of the bottom of the wallboard 1 far away from the first positioning protrusion 9 is moved out of the first positioning groove 16, and then the end with the first positioning protrusion 9 is moved out, without the need to raise the entire bottom of the wallboard 1 at once, making the disassembly labor-saving and convenient. The floor 2 and the wallboard 1 are made of a plastic material, and the wallboard 1 is blow-molded, which means that the wallboard 1 is a hollow structure, making the transportation, mounting, and disassembly of the shed convenient.

Figure 7:
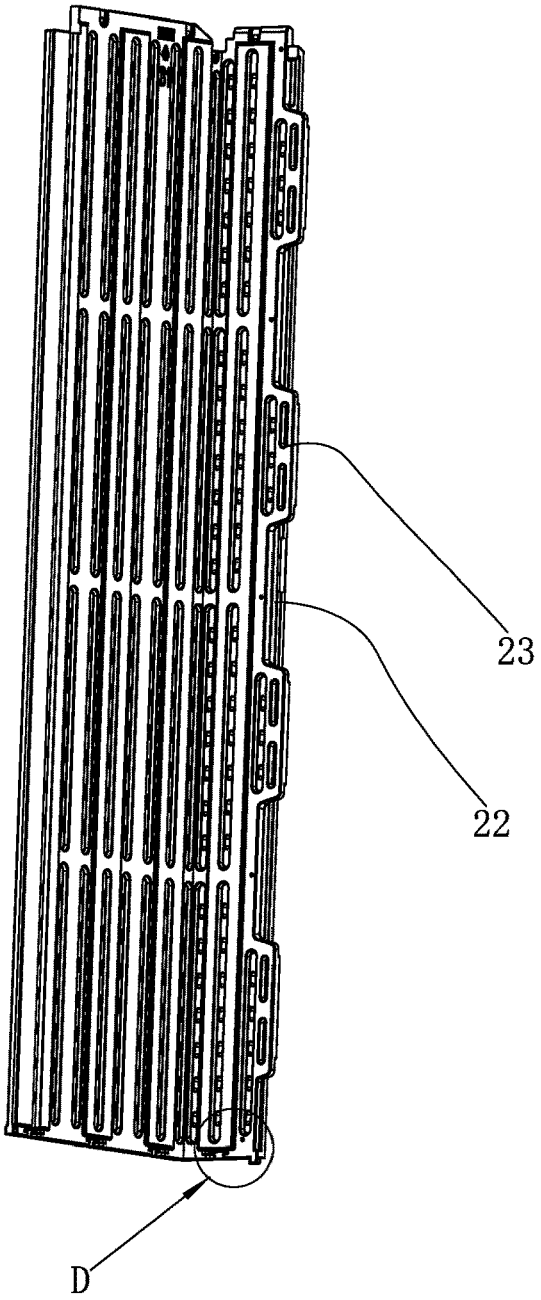
FIG. 7 is a first structural diagram of a second support plate according to the present disclosure.
Figure 8:
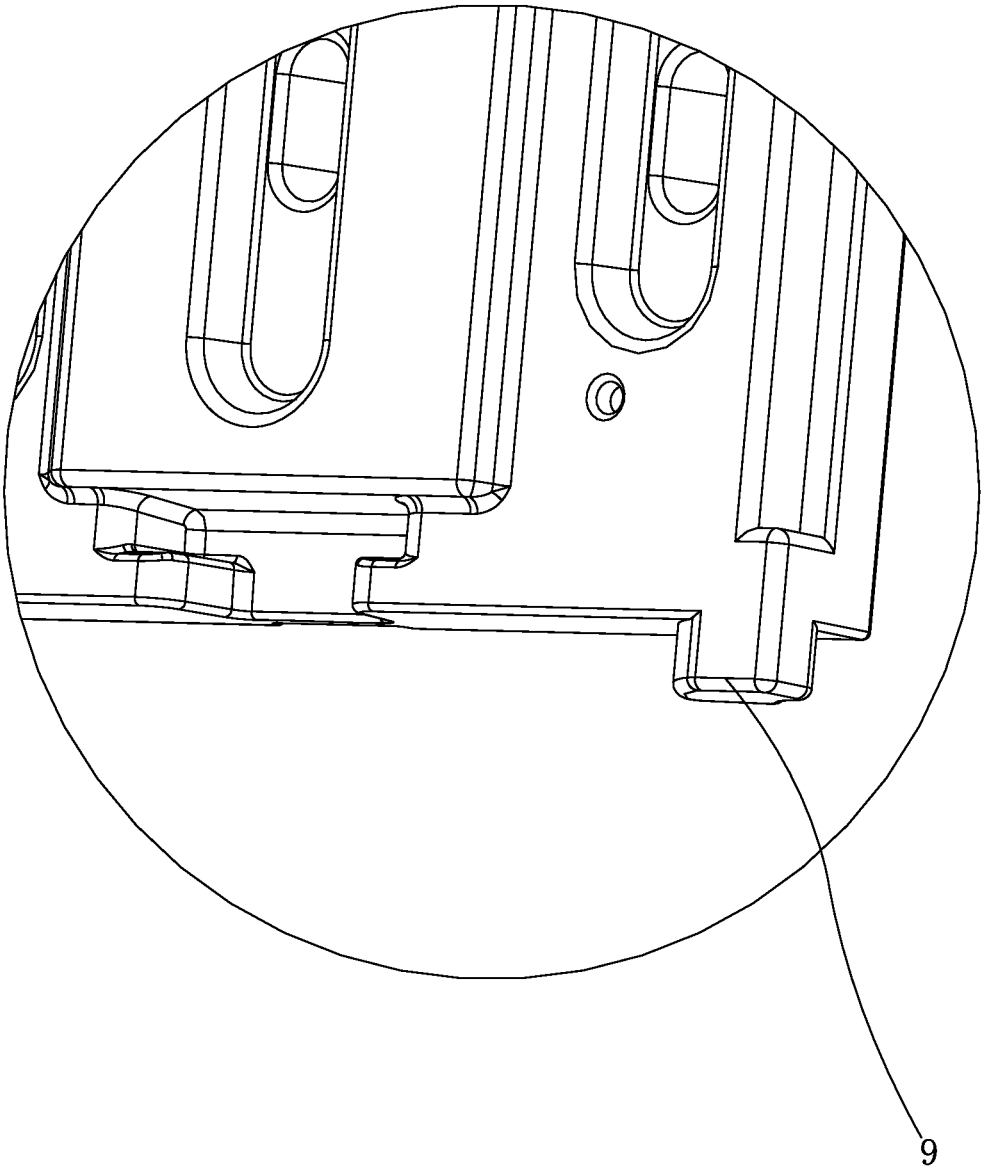
FIG. 8 is an enlarged view of D shown in FIG. 7.
Figure 9:
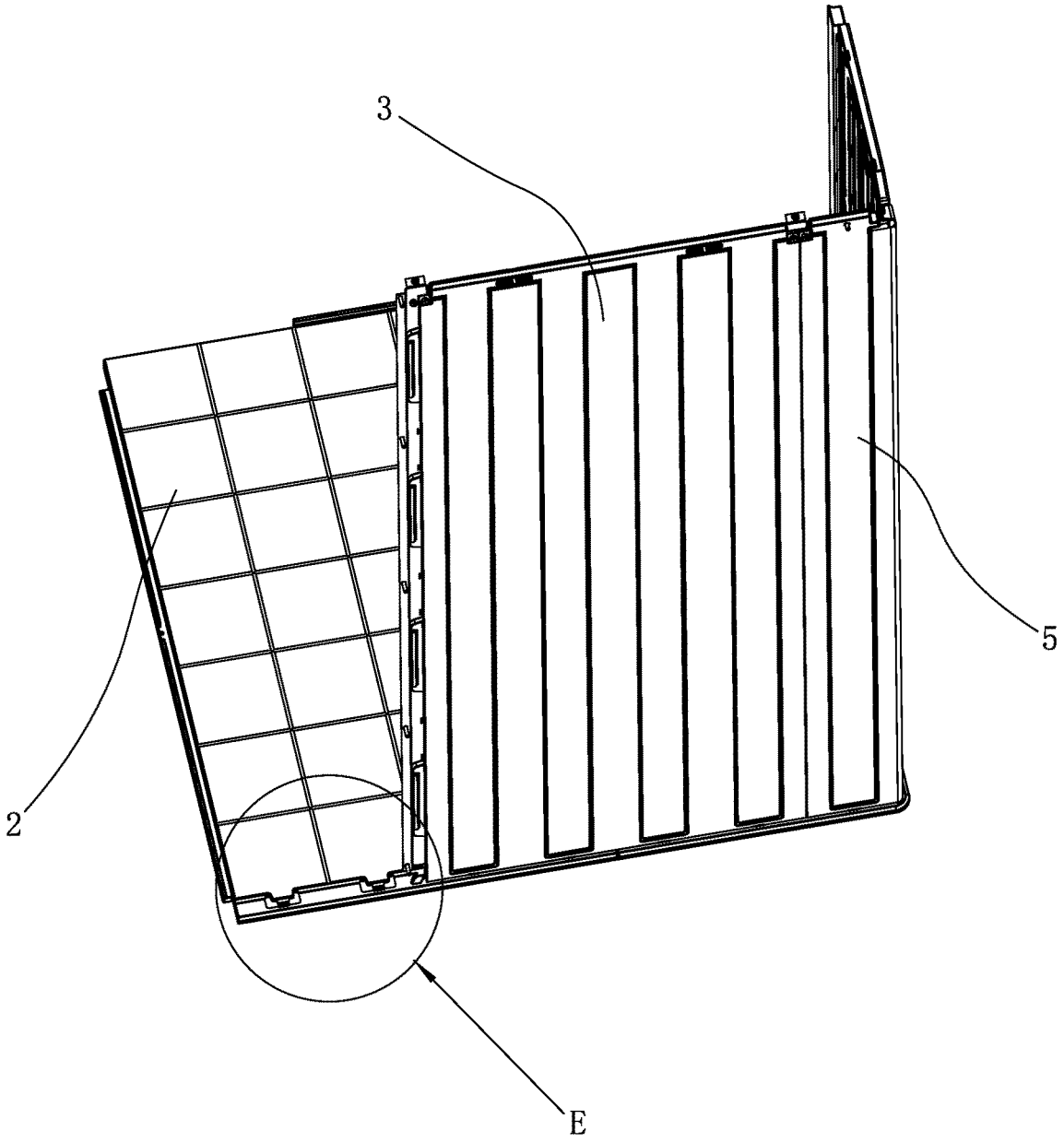
FIG. 9 is a second structural diagram of the floor and wallboard connecting structure for a shed according to the present disclosure.
Figure 11:
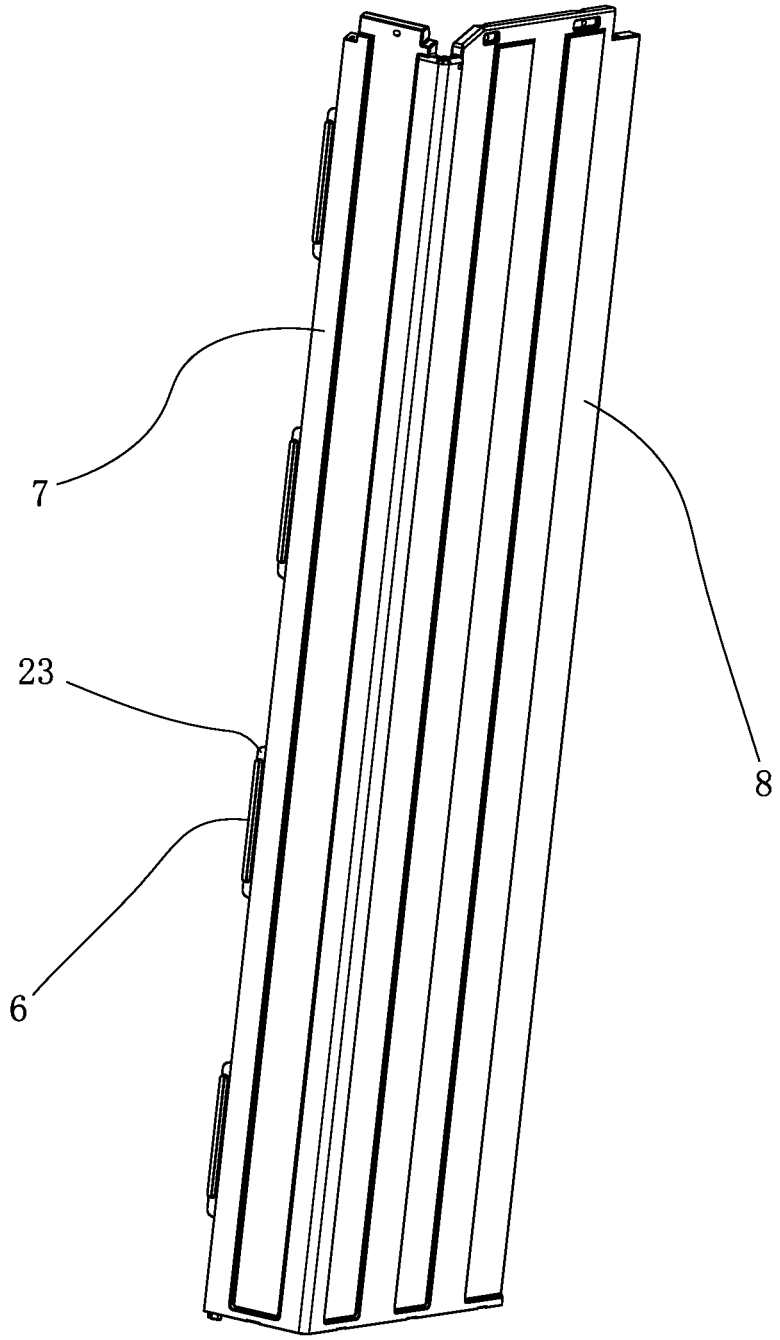
FIG. 11 is a second structural diagram of the second support plate according to the present disclosure.
Figure 12:
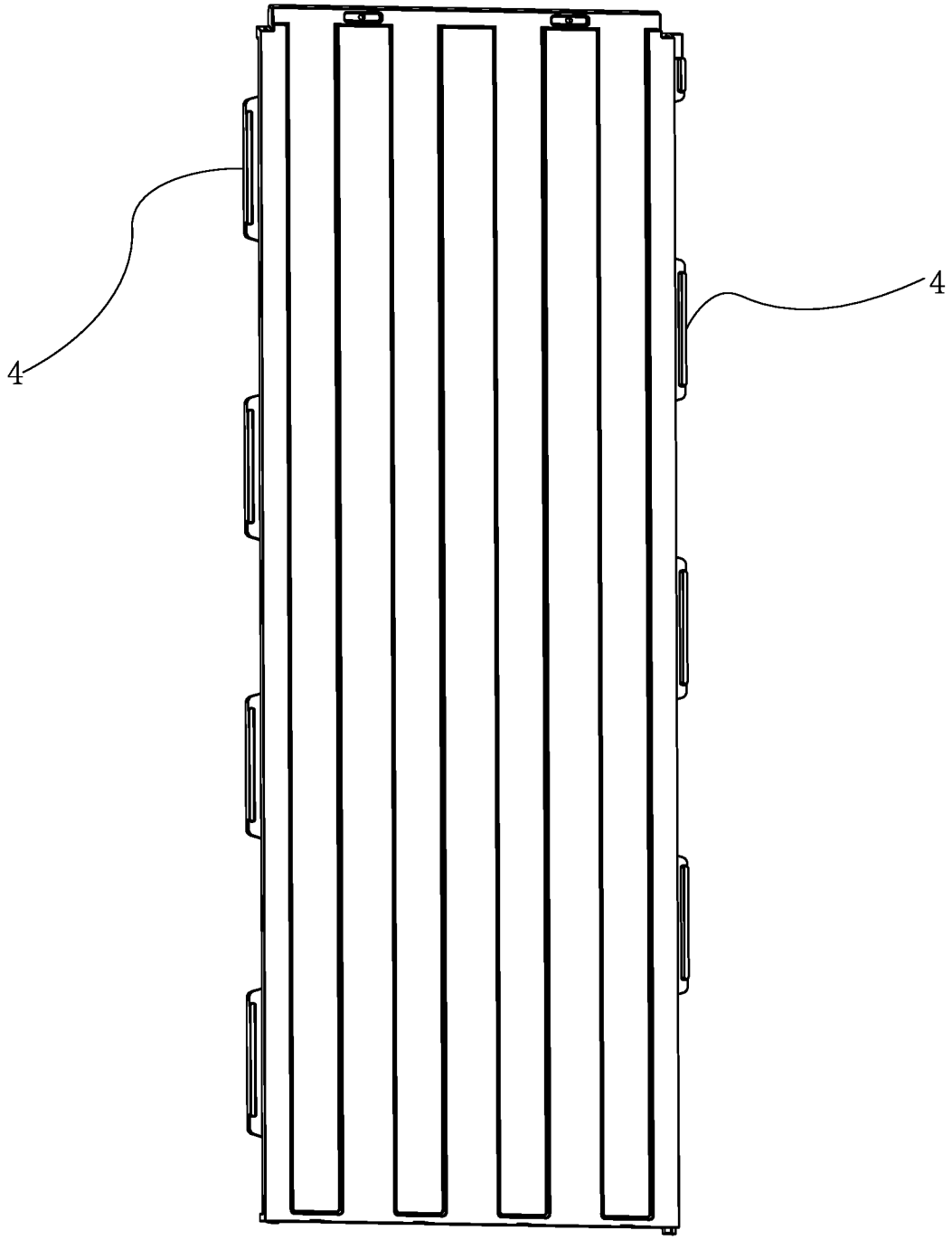
FIG. 12 is a second structural diagram of the first support plate according to the present disclosure.
Figure 13:
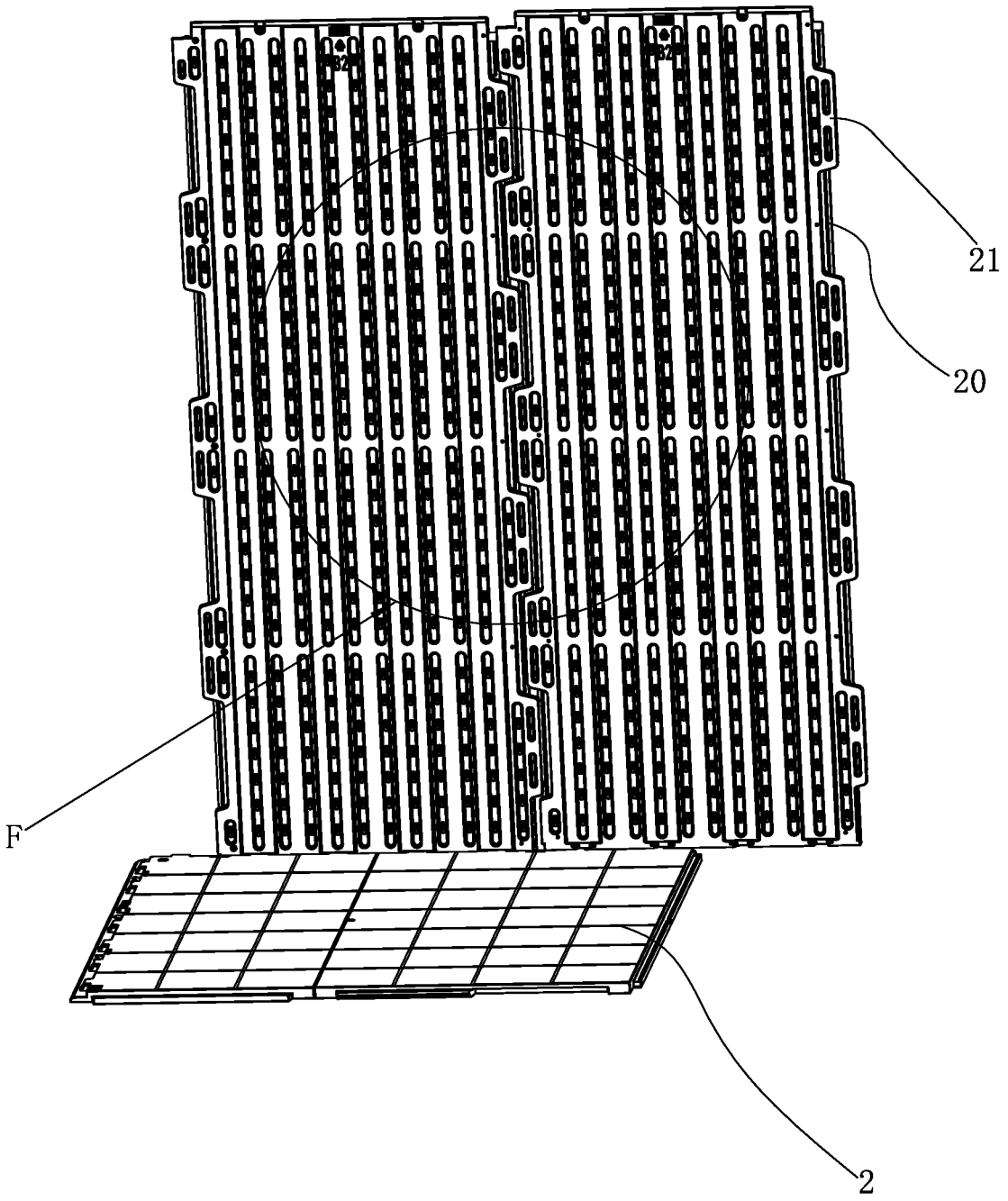
FIG. 13 is a first schematic diagram of mounting a second wallboard according to the present disclosure.
Figure 14:
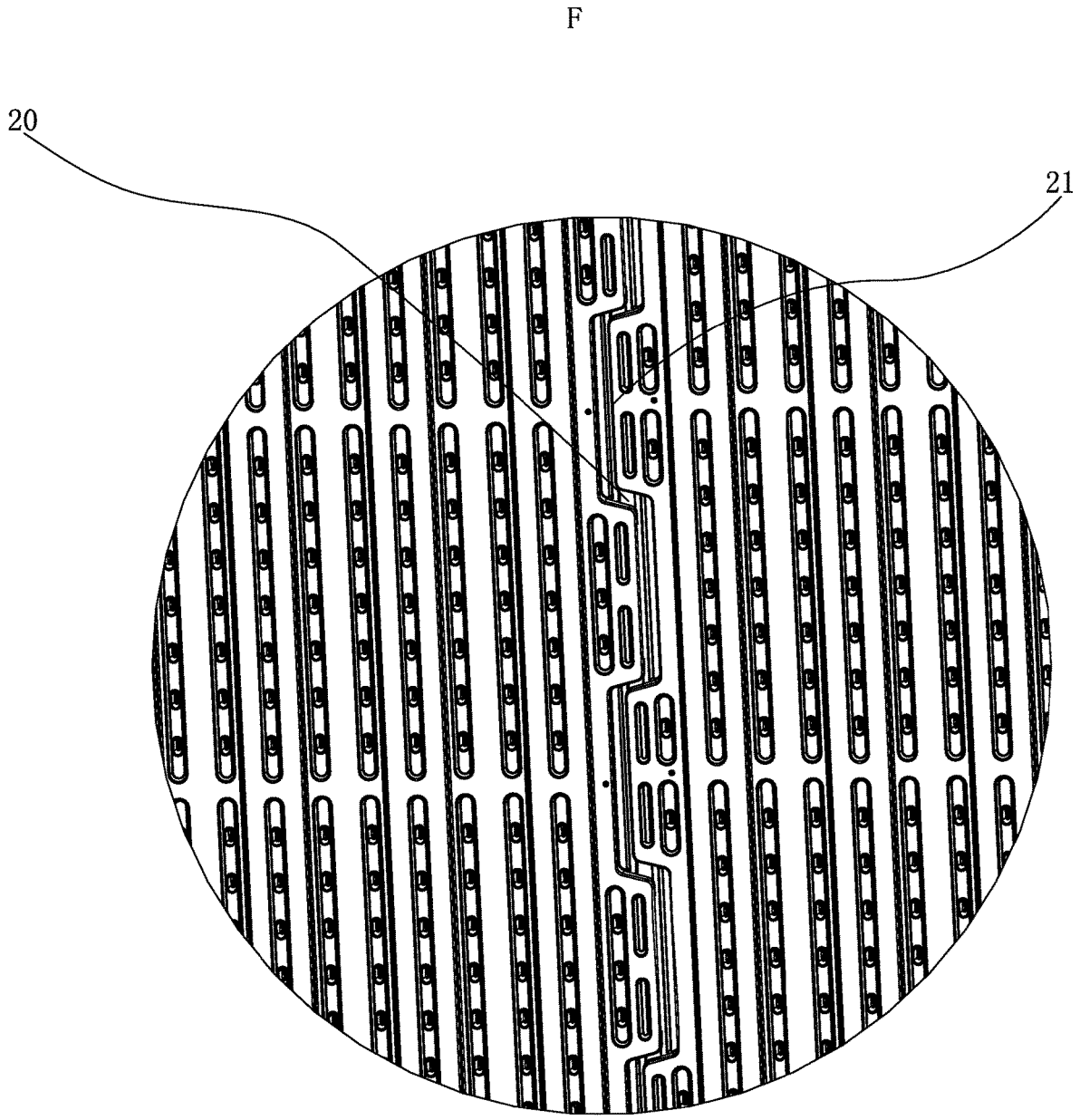
FIG. 14 is an enlarged view of F shown in FIG. 13.
Figure 15:
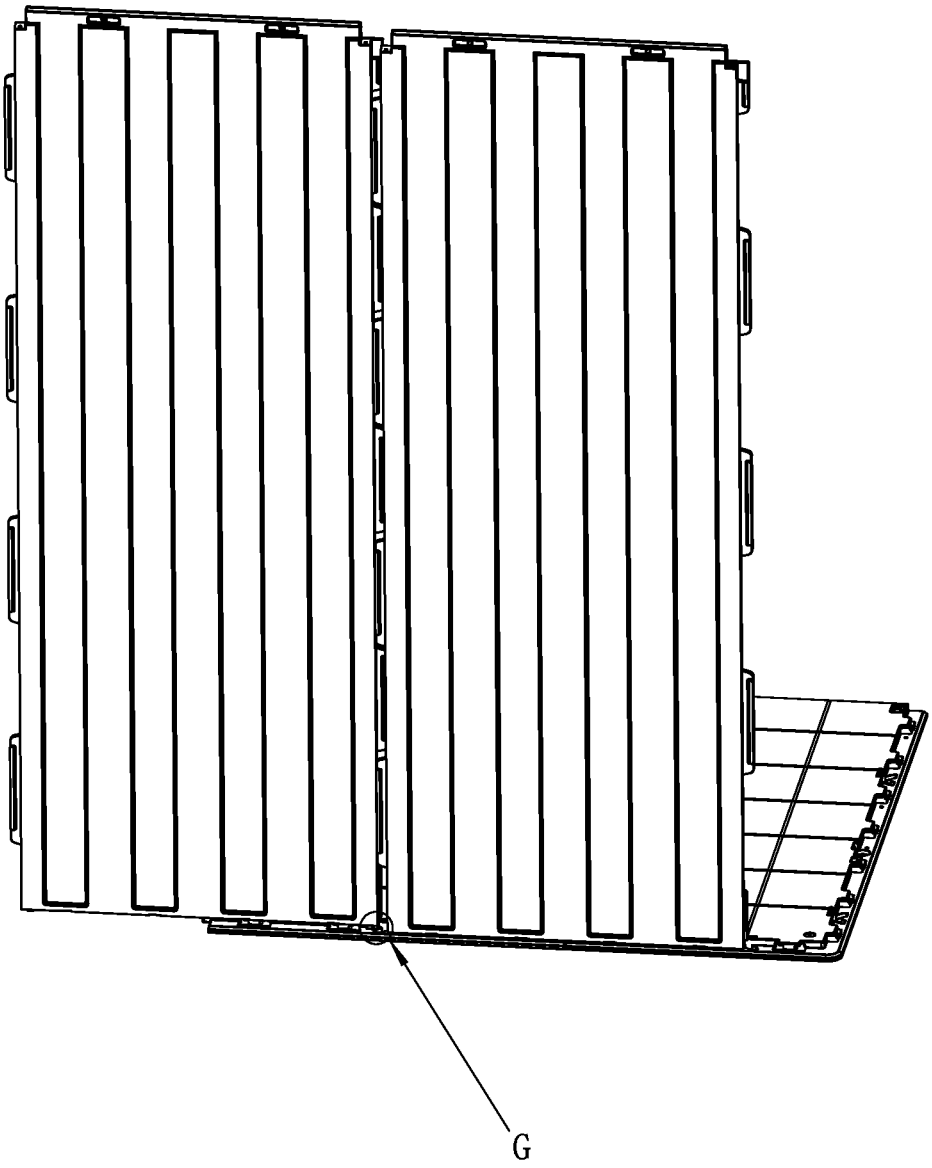
FIG. 15 is a second schematic diagram of mounting the second wallboard according to the present disclosure.
Figure 16:
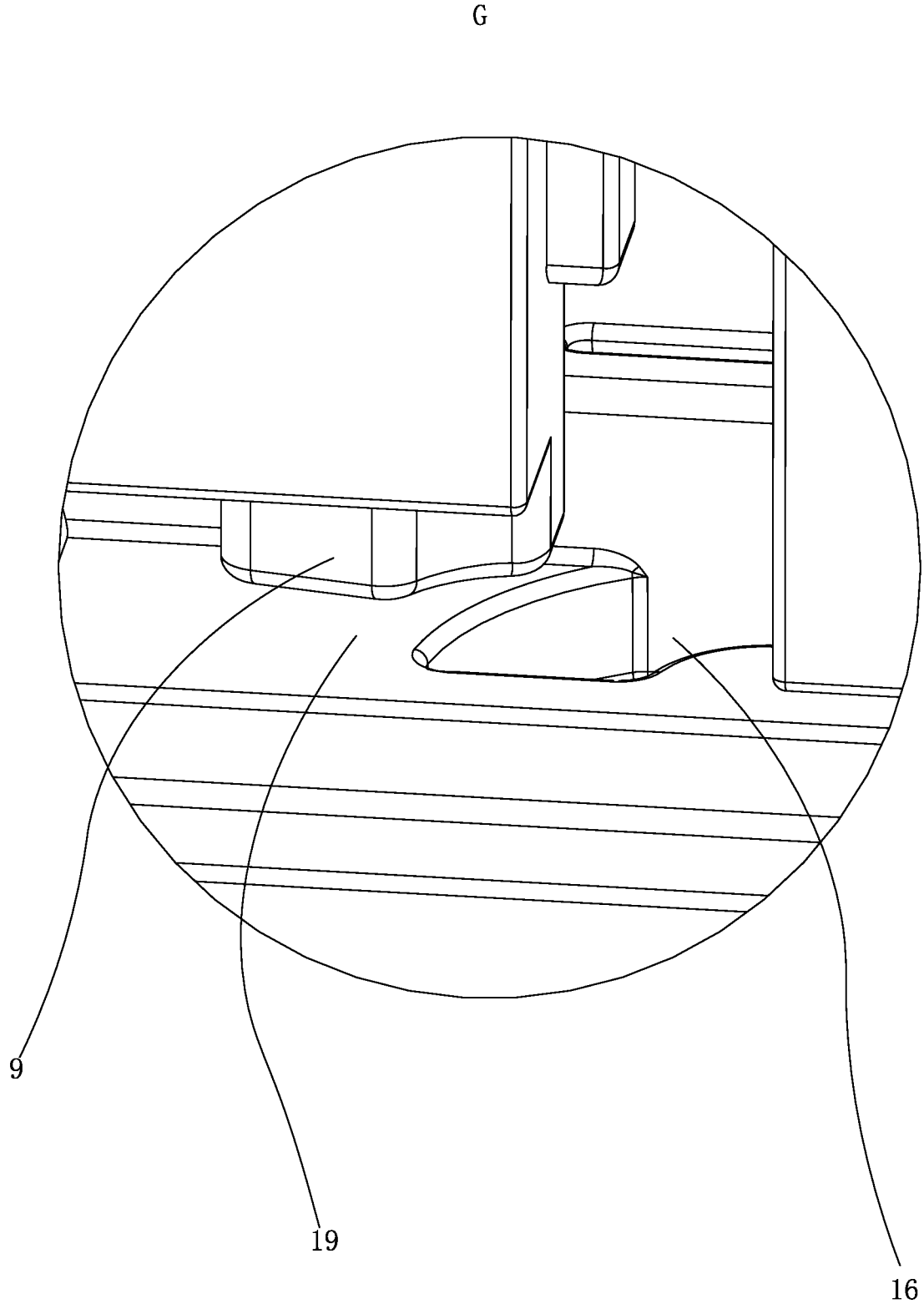
FIG. 16 is an enlarged view of G shown in FIG. 15.

Specifically, as shown in FIGS. 7 and 11, the first support plate 3 is a plate-like structure, roughly a planar structure. The first support plate 3 is configured for a connection at a position of the shed other than at the corner thereof. The second support plate 5 includes first working plate 7 and second working plate 8. The first working plate 7 and the second working plate 8 are able to be connected to the first support plate 3. The first working plate 7 and the second working plate 8 are integrated. A side of the first working plate 7 is connected to a side of the second working plate 8. After the first working plate 7 and the second working plate 8 are connected, an angle between the first working plate 7 and the second working plate 8 is greater than 0° but less than 180°. In other words, the second support plate 5 is located at the corner of the shed, and the angle at the corner can be acute, obtuse, or right. At the corner, the bottom of the wallboard 1 is connected to the floor 2, and the side of the wallboard 1 is connected to adjacent wallboard 1. Therefore, it is easy to form a connecting gap at the corner. In the present disclosure, the second support plate 5 is integrally formed by the first working plate 7 and the second working plate 8, which are mutually angled. There is a high sealing tightness between the first working plate 7 and the second working plate 8, avoiding the connection between the wallboards 1 at the corner. At the corner, it is only necessary to consider the connection between the wallboard 1 and the floor 2. On the one hand, there is no gap at the junction between the first working plate 7 and the second working plate 8, which avoids water seepage and rain leakage, improves the connection tightness of the wallboard at the corner, and ensures the safety and reliability of the shed. On the other hand, this facilitates the assembly and disassembly of the shed. Preferably, the first support plates 3 are connected to each other by a clamping method, and the first support plate 3 and the second support plate 5 are connected to each other by a clamping method. The clamping method is convenient for assembly and disassembly.

Preferably, after the first working plate 7 and the second working plate 8 are connected, the angle between the first working plate 7 and the second working plate 8 is 90°. That is, the angle at the corner of the wallboard is 90°, which allows for the reasonable utilization of the space inside the shed and avoids space waste.

Figure 6:
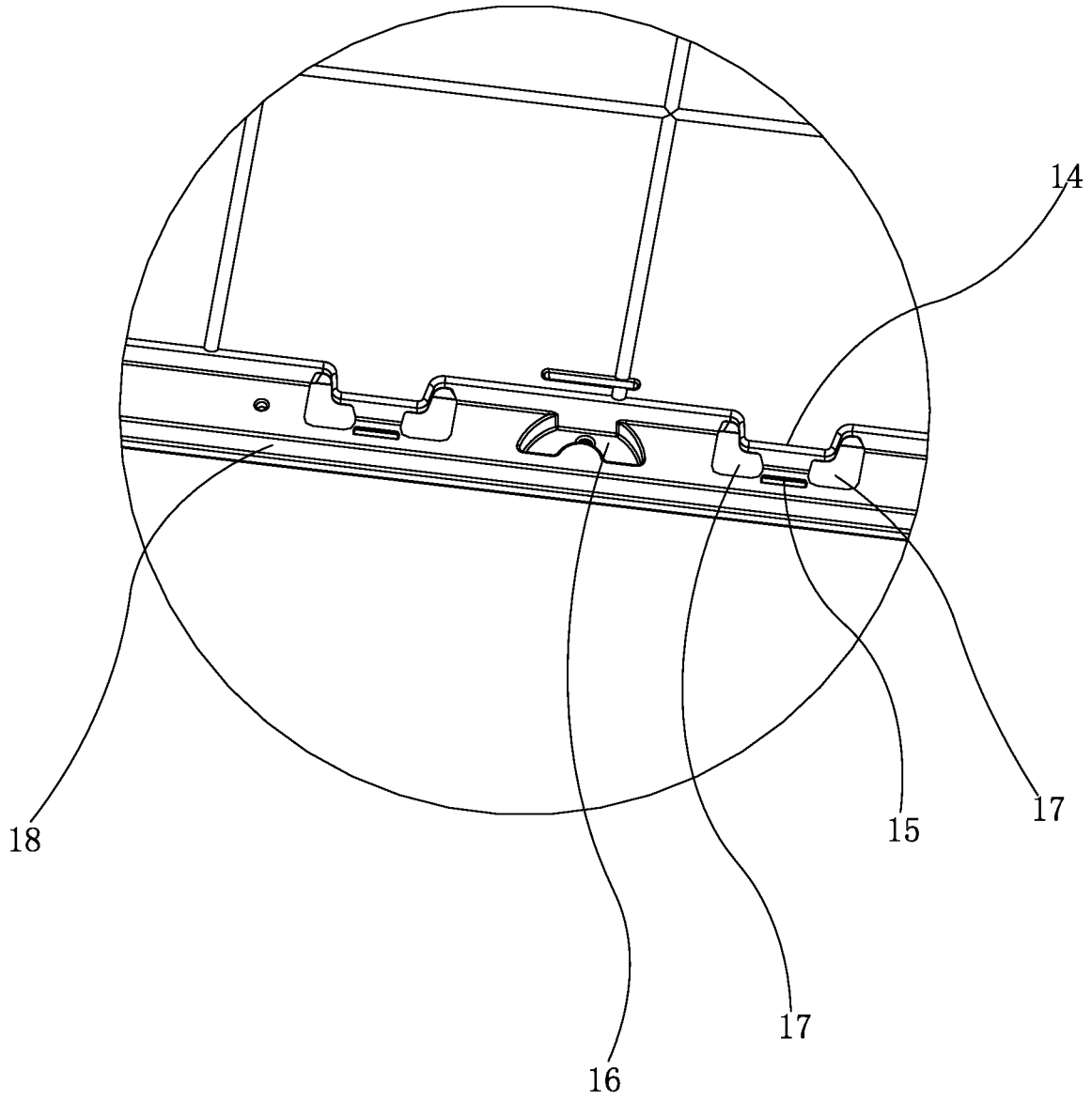
FIG. 6 is an enlarged view of C shown in FIG. 5.

Preferably, as shown in FIG. 6, a concave of the arc-shaped groove faces outward, such that the first positioning protrusion 9 at one end of the wallboard 1 is taken as a fulcrum and the other end of the wallboard 1 rotates from outside to inside into step surface 19, facilitating the mounting of the wallboard 1.

As shown in FIGS. 2, 7, 11 to 13, and 18, preferably, two sides of the first support plate 3 are provided with first clamping connectors 4 and first clamping grooves 20, and two sides of the second support plate 5 are provided with second clamping connectors 6 and second clamping grooves 22. The first clamping connectors 4 are fit with the second clamping grooves 22, and the second clamping connectors 6 are fit with the first clamping grooves 20, thereby connecting the first support plate 3 to the second support plate 5. Any two adjacent first support plates 3 are defined as a first plate and a second plate respectively. The first clamping connectors 4 of the first plate are fit with the first clamping grooves 20 of the second plate, and the first clamping grooves 20 of the first plate are fit with the first clamping connectors 4 of the second plate, thereby connecting any two adjacent first support plates 3. Each support plate of the wallboard 1 is provided with connectors and grooves, and the connectors and grooves of each two adjacent wallboards 1 form a double fit, making the connection between the wallboards 1 tight and reliable. The two sides of the first support plate 3 are provided with first protrusions 21. The first protrusions 21 are spaced from the first clamping grooves 20. The first protrusion 21 has a length smaller than a length of the first clamping groove 20 and a length of the second clamping groove 22. The first clamping connector 4 is provided on the first protrusion 21. The two sides of the second support plate 5 are provided with second protrusions 23. The second protrusions 23 are spaced from the second clamping grooves 22. The second protrusion 23 has a length smaller than a length of the first clamping groove 20 and a length of the second clamping groove 22. The second clamping connector 6 is provided on the second protrusion 23. The length of the first protrusion 21 is smaller than the length of the first clamping groove 20 and the length of the second clamping groove 22, and the length of the second protrusion 23 is smaller than the length of the first clamping groove 20 and the length of the second clamping groove 22. In this way, the first protrusion 21 and the second protrusion 23 are movable up and down in the first clamping groove 20 and the second clamping groove 22 respectively, facilitating the mounting of the wallboard 1.

As shown in FIG. 1, in order to enhance the connection stability between each two adjacent wallboards 1, first connecting plate 12 is provided at a junction between each two adjacent first support plates 3. The first connecting plate 12 is provided at a junction between the two adjacent first support plates 3 by riveting. Second connecting plate 13 is provided at a junction between the first support plate 3 and the second support plate 5. The second connecting plate 13 is provided at the junction between the first support plate 3 and the second support plate 5 by riveting. It should be noted that heights of the first connecting plate 12 and the second connecting plate 13 are basically the same as heights of the first support plate 3 and the second support plate 5. In order to maintain the external aesthetics of the shed, the first working plate 7 and the second working plate 8 are provided inside the shed. There are inevitably gaps at the junction between each two adjacent first support plates 3 and at the junction between the first support plate 3 and the second support plate 5 that are adjacent to each other. Therefore, the first connecting plate 12 is provided at the junction between each two adjacent first support plates 3 to prevent rainwater from seeping into the shed through the gap. Similarly, the second connecting plate 13 is provided at the junction between the first support plate 3 and the second support plate 5 that are adjacent to each other to prevent rainwater from seeping into the shed through the gap.

Figure 3:
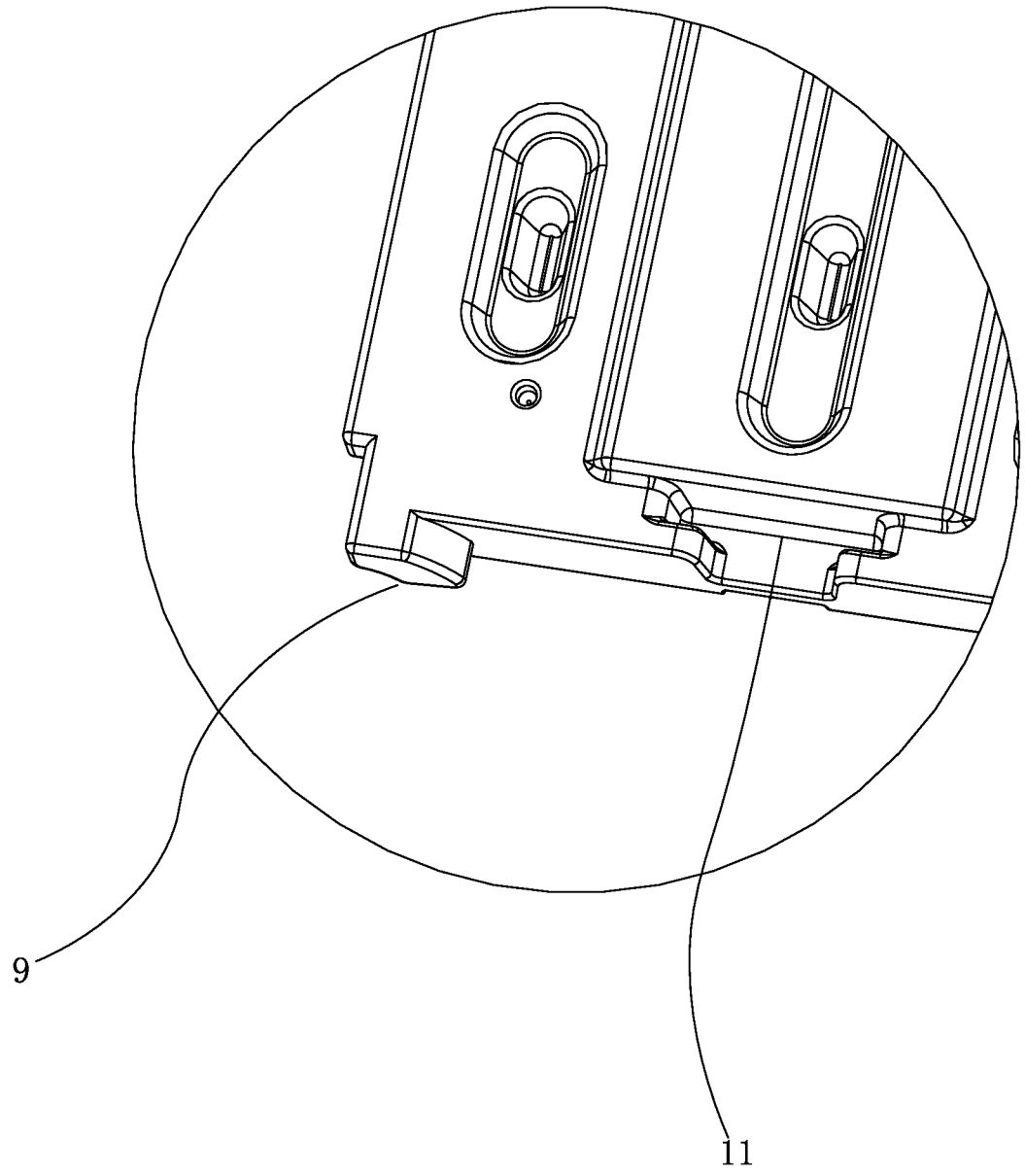
FIG. 3 is an enlarged view of A shown in FIG. 2.
Figure 4:
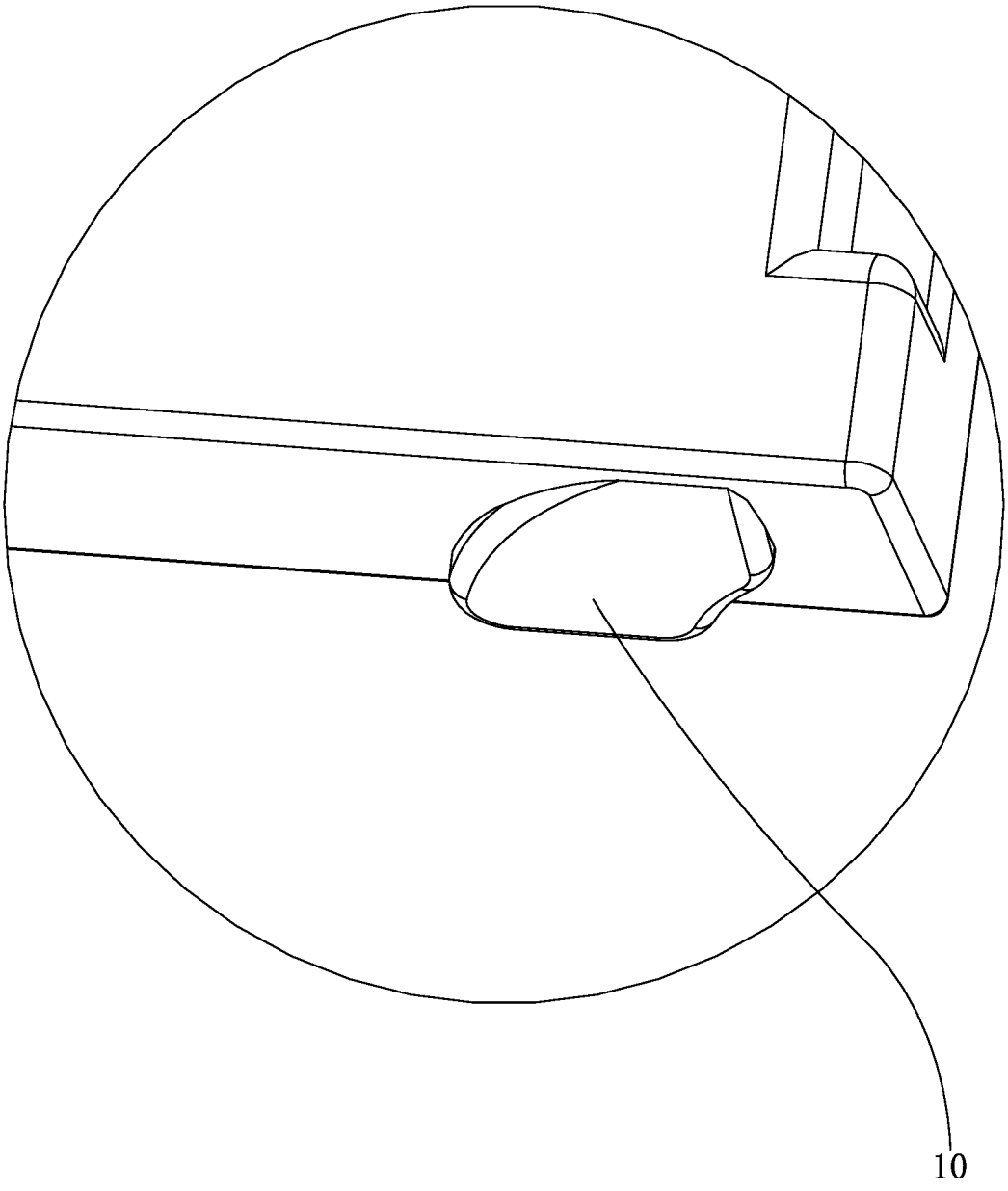
FIG. 4 is an enlarged view of B shown in FIG. 2.
Figure 5:
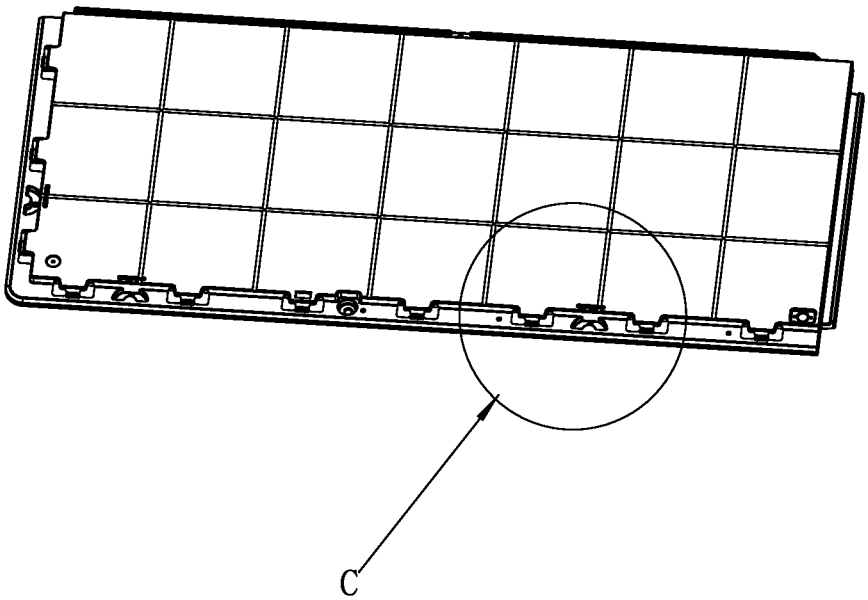
FIG. 5 is a structural diagram of a floor according to the present disclosure.

As shown in FIGS. 3 and 6, the floor 2 is provided with multiple first limit protrusions 14. Two sides of the first limit protrusion 14 are provided with hollow parts 17. An inner wall of the wallboard 1 is provided with multiple first recesses 11. The first recesses 11 are T-shaped recesses located at the bottom of the wallboard 1. The first limit protrusions 14 correspond one-to-one with the first recesses 11 in terms of quantity and position. The first limit protrusions 14 are fit with the first recesses 11 in terms of shape. The first limit protrusions 14 are fit with the first recesses 11 to connect the wallboard 1 and the floor 2. The hollow parts 17 are process holes, which are easy to be molded and for stress relief, increasing the elasticity of the floor 2 at this location, and making it easy for the first limit protrusions 14 to be inserted into or pulled out of the first recesses 11. The first positioning protrusion 9 at one end of the wallboard 1 is taken as a fulcrum, and the other end of the wallboard rotates into the floor 2. At this point, the wallboard 1 is pushed, such that the first limit protrusions 14 are inserted into the first recesses 11, thereby connecting the wallboard 1 to the floor 2.

Furthermore, the floor 2 is provided with the step surface 19. The first limit protrusion 14 and the first positioning groove 16 are provided on the step surface 19. After the wallboard 1 is connected to the floor 2, the bottom of the wallboard 1 is located on the step surface 19. The step surface 19 is open outward, making it easy to move the wallboard 1 to the floor 2 during mounting. In addition, the step surface 19 has a certain height, so the step surface 19 can prevent rainwater from entering the shed and plays a water-proof role.

In order to further strengthen the connection structure between the wallboard 1 and the floor 2, the step surface 19 is provided with multiple protrusions 15, and the bottom of the wallboard 1 is provided with multiple grooves. The protrusions 15 correspond one-to-one with the grooves in terms of quantity and position. After the wallboard 1 is connected to the floor 2, the protrusions 15 are located in the grooves. The protrusions 15 are raised bars or ridges. The protrusions 15 are located close to the first limit protrusions 14, and serve as an auxiliary connection. Preferably, the protrusion 15 is provided with a first slope. The first slope faces an outer side of the step surface 19, such that it is easy for the first recess 11 at the bottom of the wallboard 1 to slide towards the first limit protrusion 14 when the wallboard is pushed, allowing the first limit protrusion 14 to enter the first recess 11, thereby connecting the wallboard 1 to the floor 2.

As shown in FIGS. 3 to 4 and 7 to 10, it should be noted that the first positioning groove 16 includes a first mounting point and a second mounting point. The first mounting point and the second mounting point are interconnected. The bottom of the first support plate 3 is provided with second positioning protrusion 10. The second positioning protrusion 10 is provided at an end far away from the first positioning protrusion 9. Any two adjacent first support plates 3 are defined as a first plate and a second plate. After the first plate and the second plate are connected to the floor 2, the first positioning protrusion 9 of the first plate is located at the first mounting point, and the second positioning protrusion 10 of the second plate is located at the second mounting point. After the first plate and the second plate are connected, the adjacent first positioning protrusion 9 and second positioning protrusion 10 are located in the same first positioning groove 16. That is, the first positioning protrusion 9 of the first plate and the second positioning protrusion 10 of the second plate are in the same first positioning groove 16. In this way, the first positioning groove 16 of the floor 2 can simultaneously achieve the positioning of two adjacent first support plates 3 without the need for an additional positioning groove. The second positioning protrusion 10 further strengthens the connection between the first support plate 3 and the floor 2, achieving stable and reliable connection.

Specifically, a height of the first positioning protrusion 9 is defined as H1, and a height of the second positioning protrusion 10 is defined as H2, and H2 is smaller than H1. Because H2 is smaller than H1, it is easy for the second positioning protrusion 10 to enter the first positioning groove 16. When the first support plate 3 is mounted on the floor 2, the first positioning protrusion 9 first enters the first positioning groove 16. The first positioning protrusion 9 is taken as a fulcrum, and the first support plate 3 rotates to enter an appropriate position on the floor 2. Then, the second positioning protrusion 10 is aligned with adjacent first positioning groove 16, such that the second positioning protrusion 10 is located at the second mounting point of the first positioning groove 16. If the height of the second positioning protrusion 10 is too large, it will be difficult to enter the second mounting point during mounting and difficult to be pulled out from the second mounting point during disassembly.

Figure 17:
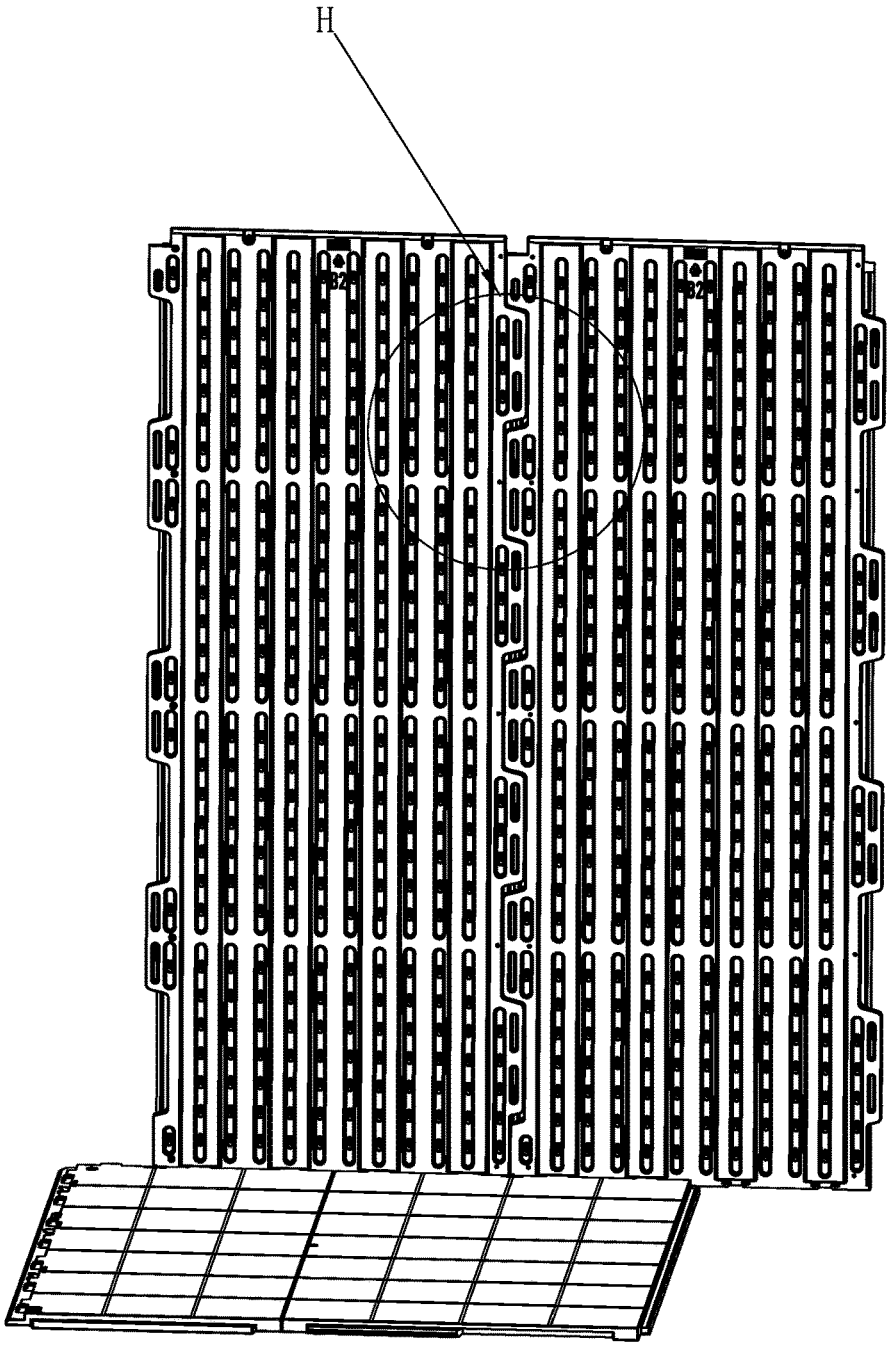
FIG. 17 is a schematic diagram when the mounting of the second wallboard is completed according to the present disclosure.
Figure 18:
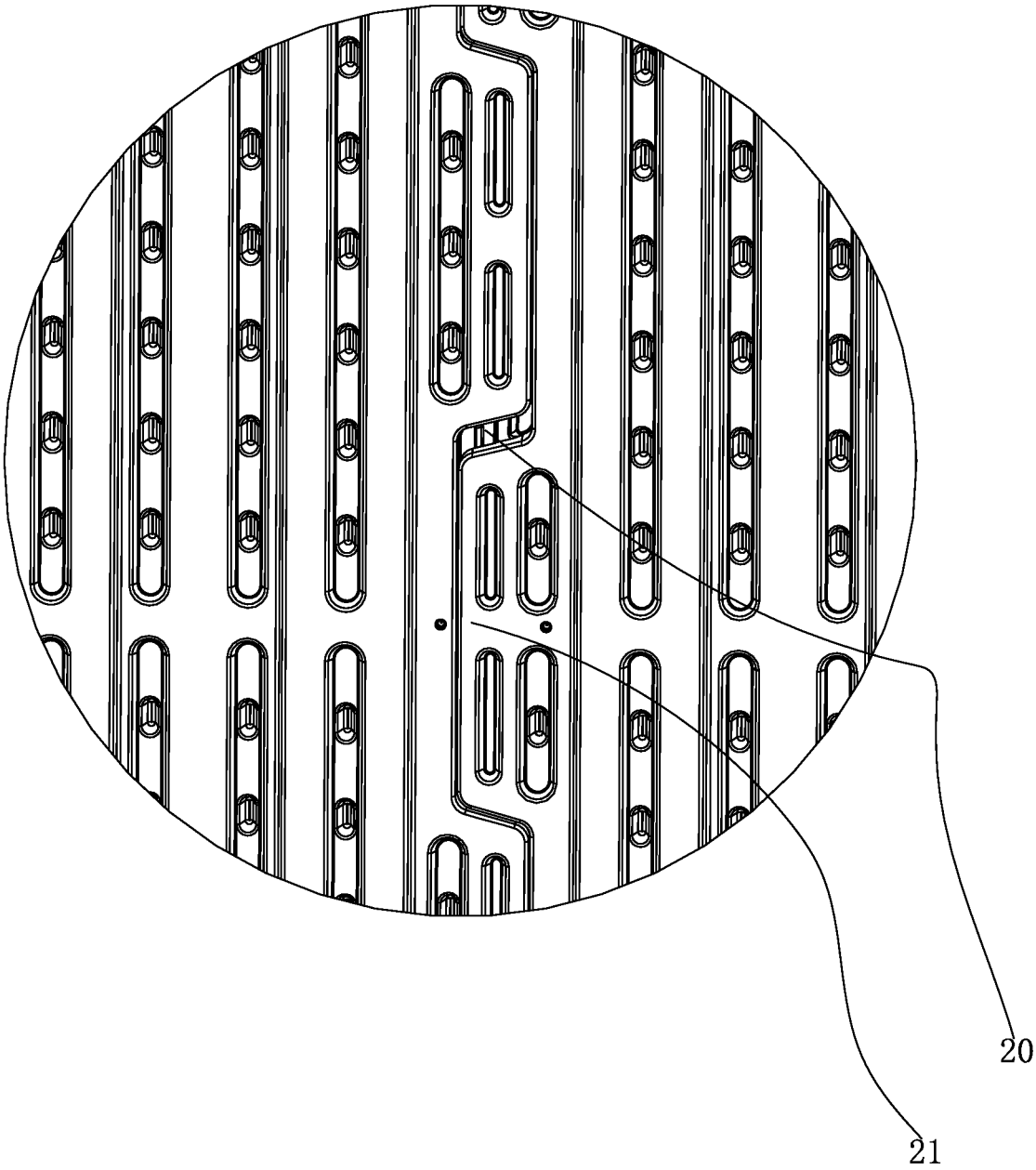
FIG. 18 is an enlarged view of H shown in FIG. 17.

It should be noted that the mounting of the wallboard of the shed starts from two sides (left or right) of a shed door. For example, a first wallboard is provided from the left of the shed door (the first wallboard is provided on the floor 2). First, the end of the wallboard with the first positioning protrusion 9 is moved into the first positioning groove 16. The first positioning protrusion 9 is taken as a fulcrum, and the wallboard 1 is rotated or pushed to make the second positioning protrusion 10 at the other end of the bottom of the wallboard fall into the second mounting point of subsequent first positioning groove 16. Thus, the mounting of the first wallboard is completed. Then, a second wallboard is provided (here the second wallboard is the first support plate). When the second wallboard is provided, first, the second wallboard is moved to the step surface 19, with one side close to the side of the first wallboard with the second positioning protrusion 10. At this point, the first clamping connector 4 of the second wallboard is located at an edge of the first clamping groove 20 of the first wallboard, the first clamping connector 4 of the first wallboard is located at an edge of the first clamping groove 20 of the second wallboard, and the first clamping connector 4 of the second wallboard is at an upper position of the first clamping groove 20 on the first wallboard (as shown in FIGS. 13 to 16). Then, the first positioning protrusion 9 of the second wallboard close to the first wallboard is taken as a fulcrum, and the second wallboard is rotated or pushed such that the first positioning protrusion 9 of the second wallboard is located at the first mounting point of the first positioning groove 16. In other words, the first positioning protrusion 9 of the second wallboard and the second positioning protrusion 10 of the first wallboard are in the same first positioning groove 16. At this point, the first clamping connector 4 of the second wallboard is located at a lower position of the first clamping groove 20 on the first wallboard. Thus, the mounting of the second wallboard is completed (as shown in FIGS. 17 to 18). The subsequent wallboard mounting is similar to the mounting of the second wallboard. Due to the limiting effect of the adjacent support plate of the wallboard and the floor 2, the connection between the support plates of the wallboard and between the wallboard and the floor is reliable.

Figure 10:
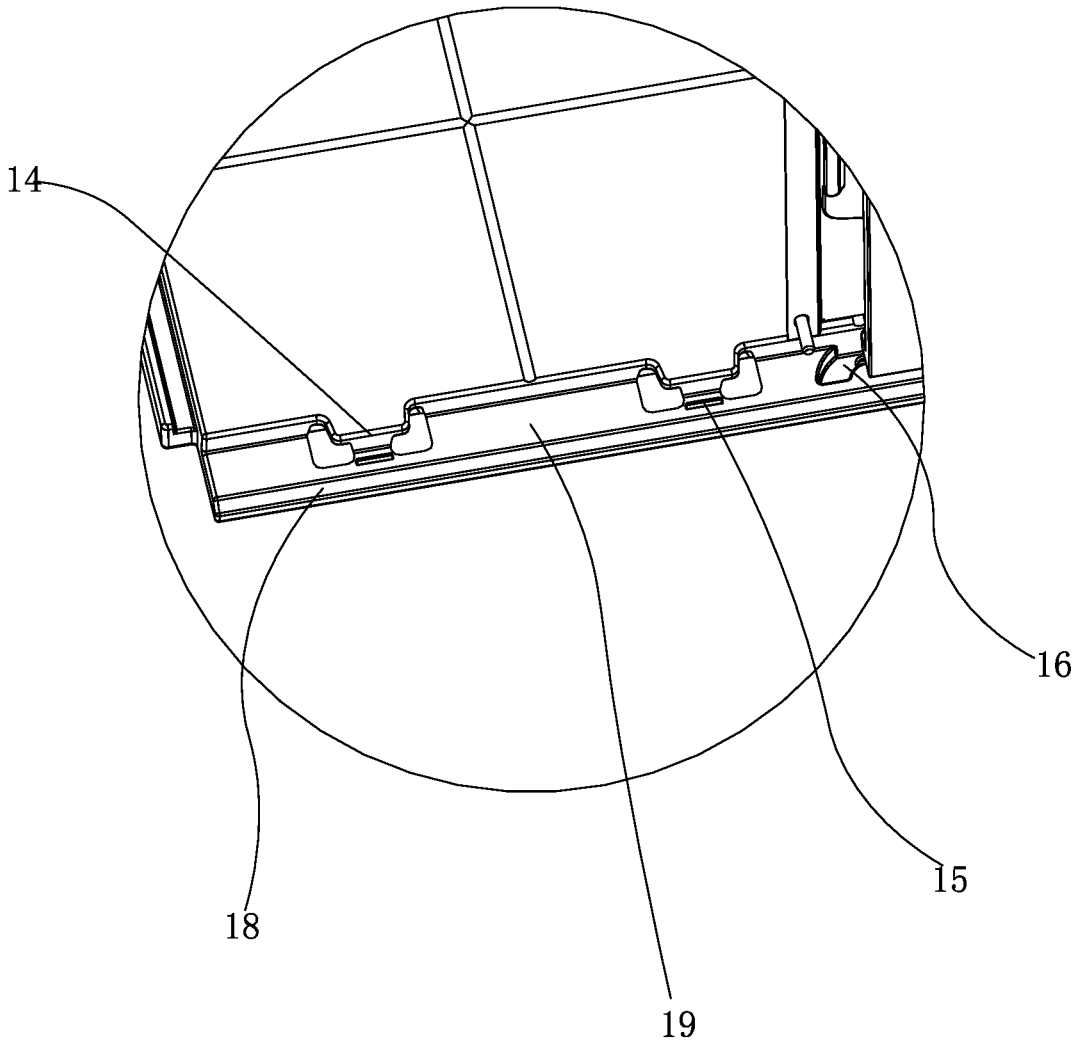
FIG. 10 is an enlarged view of E shown in FIG. 9.

As shown in FIGS. 6 and 10, in an embodiment of the present disclosure, second slope 18 is provided at an edge of the step surface 19. If the area of the wallboard 1 is large, it requires a lot of effort to mount the wallboard 1 and the floor 2. The second slope 18 is equivalent to a buffer strip. When the wallboard 11 is mounted, the wallboard 1 can be slid upwards along the second slope 18 to the step surface 19, thereby connecting the wallboard 1 to the floor 2. The second slope 18 achieves labor-saving mounting of the wallboard 1.

The present disclosure is described in detail above. Specific cases are used herein to illustrate the principle and implementation of the present disclosure, and the description of the above embodiments is only intended to help understand the core idea of the present disclosure. It should be noted that several improvements and modifications may also be made by those of ordinary skill in the art without departing from the principles of the present disclosure, which also fall within the scope of protection claimed by the present disclosure.

What is claimed is:

1. A floor and wallboard connecting structure for a shed, comprising:

a floor and a wallboard, wherein the wallboard comprises multiple first support plates and multiple second support plates;

the second support plates are located at respective corners of the shed;

the first support plates each are connected to an adjacent said first support plate or to an adjacent said second support plate;

a bottom of each first support plate is provided with a first positioning protrusion at one end and a second positioning protrusion and an opposite end thereof, and a bottom of each second support plate is also provided with a first positioning protrusion at one end and a second positioning protrusion and an opposite end thereof;

the floor is provided with first positioning grooves;

the first positioning grooves are engaged with the first positioning protrusions to limit movement of one end of a bottom of the wallboard relative to the floor;

the first positioning grooves are arc-shaped grooves; and the first positioning protrusions are rotatable in the first positioning grooves;

wherein a height of each first positioning protrusion is greater than a height of each second positioning protrusion;

wherein a side of each first support plate is provided with first clamping connectors and first clamping grooves, and a side of each second support plate is provided with second clamping connectors and second clamping grooves;

the first clamping connectors are engaged with the second clamping grooves, and the second clamping connectors are engaged with the first clamping grooves, thereby connecting the first support plates to the second support plates;

wherein at least two adjacent support plates comprise a respective said first support plate and a respective said second support plate and the first clamping connectors of the respective first support plate are engaged with the first clamping grooves of the respective second support plate, and the first clamping grooves of the respective first support plate are engaged with the first clamping connectors of the respective second support plate, thereby connecting the two adjacent support plates;

the side of each first support plate is provided with first support protrusions;

the first support protrusions are spaced from the first clamping grooves;

each first clamping connector is provided on a respective said first support protrusion;

the side of each second support plate is provided with second support protrusions;

the second support protrusions are spaced from the second clamping grooves;

each second clamping connector is provided on a respective said second support protrusion;

each first support protrusion has a length smaller than a length of the first clamping grooves and a length of the second clamping grooves; and each second support protrusion has a length smaller than the length of the first clamping grooves and the length of the second clamping grooves.

2. The connecting structure according to claim 1, wherein the first positioning groove comprises a first mounting point and a second mounting point; the second positioning protrusion is provided at an end far away from the first positioning protrusion; and wherein the respective first support plate and the respective second support plate are connected to the floor, and the first positioning protrusion of the respective first support plate is located at the first mounting point, and the second positioning protrusion of the respective second support plate is located at the second mounting point.

3. The connecting structure according to claim 1, wherein the second support plates each comprise a first working plate and a second working plate; a side of the first working plate is connected to a side of the second working plate; and after the first working plate and the second working plate are connected, an angle between the first working plate and the second working plate is greater than 0° but less than 180°.

4. The connecting structure according to claim 3, wherein after the first working plate and the second working plate are connected, the angle between the first working plate and the second working plate is 90°.

5. The connecting structure according to claim 1, wherein the floor is provided with multiple first limit protrusions; an inner wall of the wallboard is provided with multiple first recesses; the first recesses are located at the bottom of the wallboard; and the first limit protrusions are engaged with the first recesses to connect the wallboard to the floor.

6. The connecting structure according to claim 5, wherein the floor is provided with a step surface; the first limit protrusion and the first positioning groove are provided on the step surface; and after the wallboard is connected to the floor, the bottom of the wallboard is located on the step surface.

7. The connecting structure according to claim 6, wherein the step surface is provided with multiple step protrusions, and the bottom of the wallboard is provided with multiple step grooves; the step protrusions correspond one-to-one with the step grooves in terms of quantity and position; and after the wallboard is connected to the floor, the step protrusions are located in the step grooves.

8. The connecting structure according to claim 7, wherein the step protrusions are raised bars or ridges; and the step protrusions each are provided with a first slope.

* * * * *